US008966712B1

(12) United States Patent
Yu

(10) Patent No.: US 8,966,712 B1
(45) Date of Patent: Mar. 3, 2015

(54) DOOR OPERATOR

(71) Applicant: Chia-Chu Yu, Taichung (TW)

(72) Inventor: Chia-Chu Yu, Taichung (TW)

( * ) Notice: Subject to any disclaimer, the term of this patent is extended or adjusted under 35 U.S.C. 154(b) by 0 days.

(21) Appl. No.: 14/144,837

(22) Filed: Dec. 31, 2013

(51) Int. Cl.
*E05F 3/02* (2006.01)

(52) U.S. Cl.
USPC ..... 16/66; 49/341; 16/69; 16/79

(58) Field of Classification Search
USPC ..... 49/324, 339, 340, 341, 343, 345, 386; 16/49, 66–70, 64, 65, 61, 62, 71, 79, 16/80, 72, 75, 76, 84
See application file for complete search history.

(56) References Cited

U.S. PATENT DOCUMENTS

| | | | | | |
|---|---|---|---|---|---|
| 3,934,307 | A * | 1/1976 | Lasier et al. | 16/79 |
| 4,080,687 | A * | 3/1978 | Jentsch | 16/52 |
| 4,083,080 | A * | 4/1978 | Miyazawa | 16/66 |
| 4,102,004 | A * | 7/1978 | Nagase | 16/49 |
| 4,115,897 | A * | 9/1978 | Zunkel | 16/49 |
| 4,234,996 | A * | 11/1980 | Jentsch | 16/52 |
| 4,263,694 | A * | 4/1981 | Jentsch | 16/48.5 |
| 4,285,094 | A * | 8/1981 | Levings, Jr. | 16/52 |
| 4,419,786 | A * | 12/1983 | Surko, Jr. | 16/51 |
| 4,580,365 | A * | 4/1986 | Sieg | 49/336 |
| 4,665,583 | A * | 5/1987 | Frolov et al. | 16/52 |
| 5,343,593 | A * | 9/1994 | Fayngersh | 16/52 |
| 5,513,467 | A * | 5/1996 | Current et al. | 49/340 |
| 5,535,514 | A * | 7/1996 | Lucas | 29/888.06 |
| 5,687,507 | A * | 11/1997 | Beran | 49/340 |
| 6,223,469 | B1 * | 5/2001 | Moll | 49/341 |
| 6,262,548 | B1 * | 7/2001 | Scholten et al. | 318/445 |
| 6,412,224 | B1 * | 7/2002 | Feucht et al. | 49/340 |
| 7,571,515 | B2 * | 8/2009 | Fischbach et al. | 16/79 |
| 7,815,023 | B2 * | 10/2010 | Salutzki | 188/322.22 |
| 8,528,459 | B2 * | 9/2013 | Plavnik | 91/395 |
| 8,613,126 | B2 * | 12/2013 | Blockley | 16/71 |
| 2006/0010771 | A1 * | 1/2006 | Houser et al. | 49/341 |
| 2006/0075684 | A1 * | 4/2006 | Hansch et al. | 49/340 |
| 2007/0022664 | A1 * | 2/2007 | Mahonen et al. | 49/342 |
| 2011/0191981 | A1 * | 8/2011 | Bell | 16/72 |

* cited by examiner

*Primary Examiner* — Katherine Mitchell
*Assistant Examiner* — Justin Rephann
(74) *Attorney, Agent, or Firm* — Rosenberg, Klein & Lee

(57) ABSTRACT

A door operator includes an installation box, an operating mechanism, a pneumatic apparatus and a moveable sleeve. The installation box has a housing and a lid. The housing has an assembling space and an opening communicating with the assembling space; the lid is mounted in the opening and covers the assembling space. The operating mechanism is rotatably mounted in the installation box and has a gear. The pneumatic apparatus is installed in the assembling space and has a cylinder and a piston rod. The moveable sleeve is movably mounted on the cylinder and connected with the piston rod and engaged with the gear of the operating mechanism. Because a rotation axis of the gear and a central axis of the moveable sleeve are perpendicular to each other, the volume of the installation box can be reduced.

11 Claims, 12 Drawing Sheets

DOOR OPERATOR

BACKGROUND OF THE INVENTION

1. Field of the Invention

The present invention relates to a mechanism for opening and closing a door, and more particularly to a door operator.

2. Description of Related Art

A conventional door operator is applied to close and open a door. The door operator can close the door automatically to prevent the air leaking from indoor area and to keep dirt or cats and dogs stay at the outdoor area. The door operator also can help a user to open doors in a labor-saving manner.

The conventional door operator is usually mounted between a door and a door frame and has a swinging arm and a cylinder. When the door is opening, the swinging arm is moved to push or pull a piston of the cylinder. Air inside of the cylinder will flow and generate a cushion effect by pushing or pulling the piston, and then the door can be closed or opened by the door operator automatically and easily.

However, a stroke of the cylinder of the conventional door operator is relative long so a length of a housing and the volume of the door operator are relative large. As such, the appearance of the door operator is not appealing enough.

To overcome the shortcomings of the conventional door operator, the present invention provides a door operator to mitigate or obviate the aforementioned problems.

SUMMARY OF THE INVENTION

The main objective of the invention is to provide a door operator; the door operator includes an installation box, an operating mechanism, a pneumatic apparatus, and a moveable sleeve.

The installation box has a housing and a lid; the housing has a top, a bottom, an assembling space, and an opening communicating with the assembling space; the lid is mounted in the opening and covers the assembling space.

The operating mechanism is rotatably connected with the installation box and has a shaft, a gear, a swing arm and a rack; the shaft is rotatably mounted on the top of the housing through the bottom of the housing; the gear is mounted on the shaft, is driven by the shaft, and has a rotation axis; the swing arm has two ends, one of the ends of the swing arm is pivotally mounted on a top end of the shaft and outside the housing; the rack is connected to the other end of the swing arm.

The pneumatic apparatus is installed in the assembling space and has a cylinder, a piston rod, an adjusting rod, a piston block, a sealing ring, a clutch ring, a first spring, and a second spring.

The cylinder has an inner space and an insertion hole communicating with the inner space.

The piston rod is moveably mounted in the insertion hole of the cylinder.

The adjusting rod is connected with the piston rod and has an air-in slit longitudinally formed in a periphery of the adjusting rod.

The piston block is mounted around the adjusting rod and has a first face, an abutment recess, multiple air outlets and an air inlet; the first face is defined at one side of the piston block, the abutment recess is formed in the first face of the piston block and has a bottom, the air outlets are formed through the bottom of the abutment recess and arranged circularly, the air inlet is mounted through a periphery of the piston block and corresponding in position to and communicating with the air-in slit.

The sealing ring is mounted in the abutment recess and covers the air outlets.

The clutch ring is mounted around the adjusting rod and engaged with the piston block.

The first spring abuts between the clutch ring and the piston rod.

The second spring is mounted in the abutment recess and abuts between the sealing ring and the clutch ring.

The moveable sleeve is movably mounted around the cylinder and connected with the piston rod; the moveable sleeve has a gear face and a central axis, the central axis of the moveable sleeve is perpendicular to the rotation axis of the gear, and the gear face is correspondingly engaged with the gear.

Other objects, advantages, and novel features of the invention will become more apparent from the following detailed description when taken in conjunction with the accompanying drawing.

DETAILED DESCRIPTION OF PREFERRED EMBODIMENT

With reference to FIGS. 1 to 5, a preferred embodiment of a door operator in accordance with the present invention has an installation box 10, an operating mechanism 20, a pneumatic apparatus 30 and a moveable sleeve 40.

Figure 1:
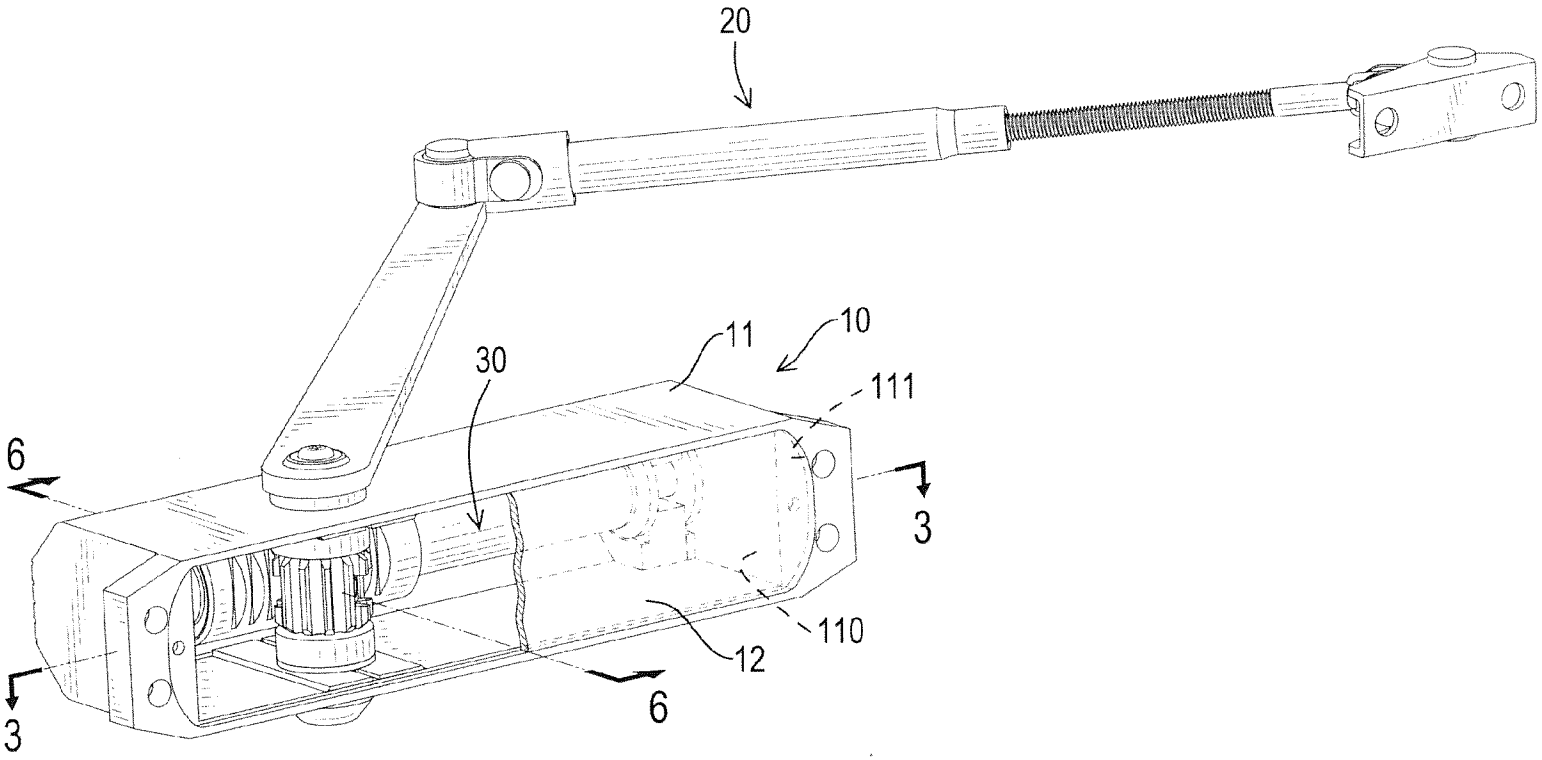
FIG. 1 is a perspective view in partial section of a door operator in accordance with the present invention.
Figure 2:
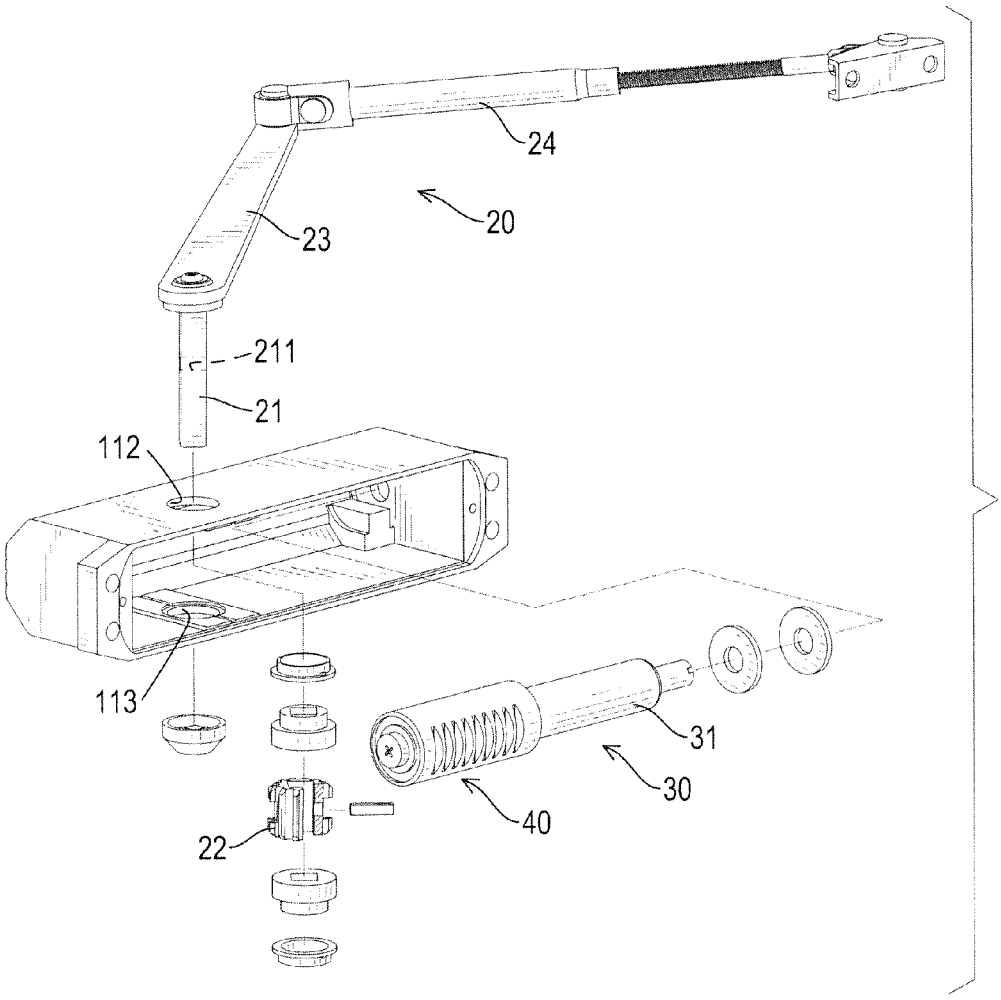
FIG. 2 is an exploded perspective view of an operating mechanism of the door operator in FIG. 1.

With reference to FIGS. 1 and 2, the installation box 10 has a housing 11 and a lid 12. The housing 11 has a top, a bottom, an assembling space 110, an opening 111, a through hole 112 and an assembling hole 113. The assembling space 110 is formed inside the housing 11. The opening 111 is formed in the housing 11 and communicates with the assembling space 110. The through hole 112 is formed in the top of the housing 11. The assembling hole 113 is formed in the bottom of the housing 11. The through hole 112 and the assembling hole 113 are coaxial with each other and communicate with the assembling space 110. The lid 12 is mounted in the opening 111 and closes the assembling space 110.

With reference to FIGS. 1 and 2, the operating mechanism 20 is rotatably connected with the installation box 10 and has a shaft 21, a gear 22, a swing arm 23 and a rack 24. The shaft 21 is rectangular in cross section, and is rotatably mounted through the through hole 112 and the assembling hole 113. The gear 22 is mounted around the shaft 21 and is accommodated in the assembling space 110. The gear 22 has a rotation axis and is driven by the shaft 21. The swing arm 23 has two ends, and one of the ends of the swing arm 23 is pivotally mounted on a top end of the shaft 21 and outside the housing 11. The rack 24 has two ends, one of the ends of the rack 24 is connected to the other end of the swing arm 23, and the other end of the rack 24 can be installed on a door frame.

Figure 3:
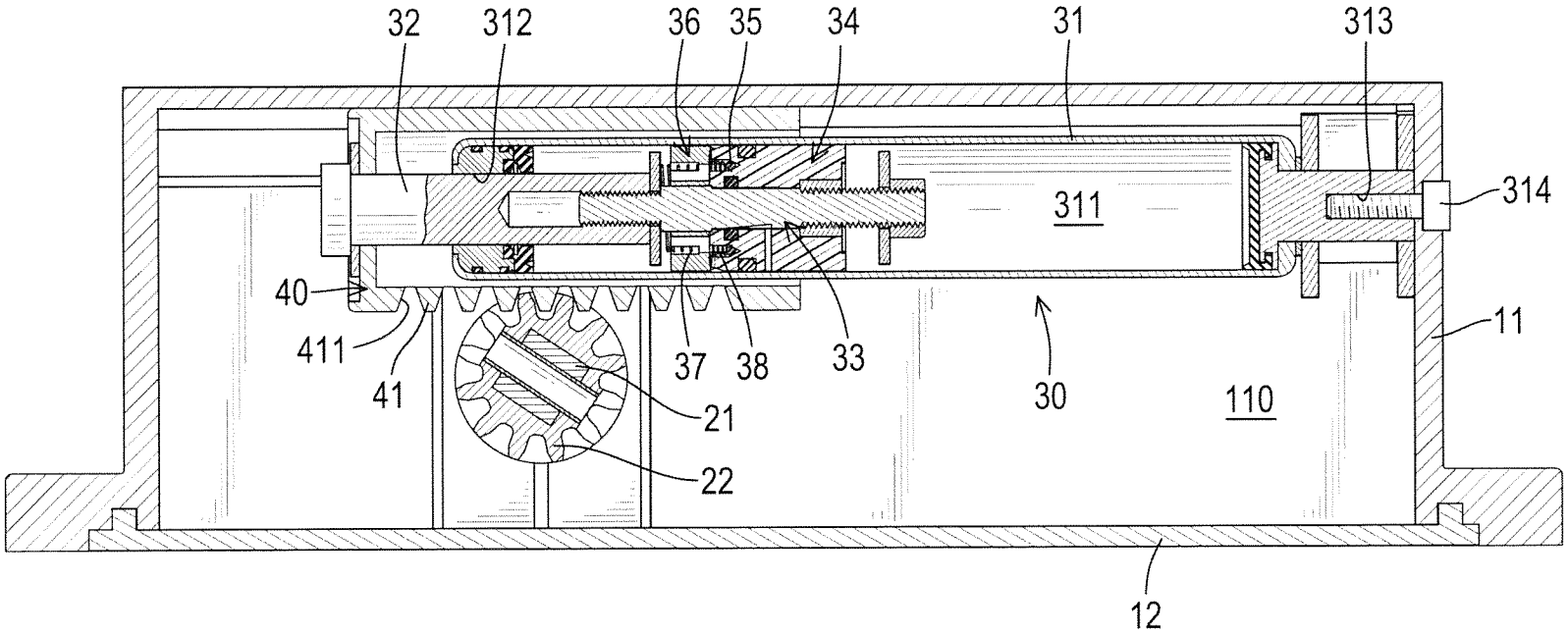
FIG. 3 is a cross-sectional top view of the door operator along line 3-3 in FIG. 1.
Figure 4:
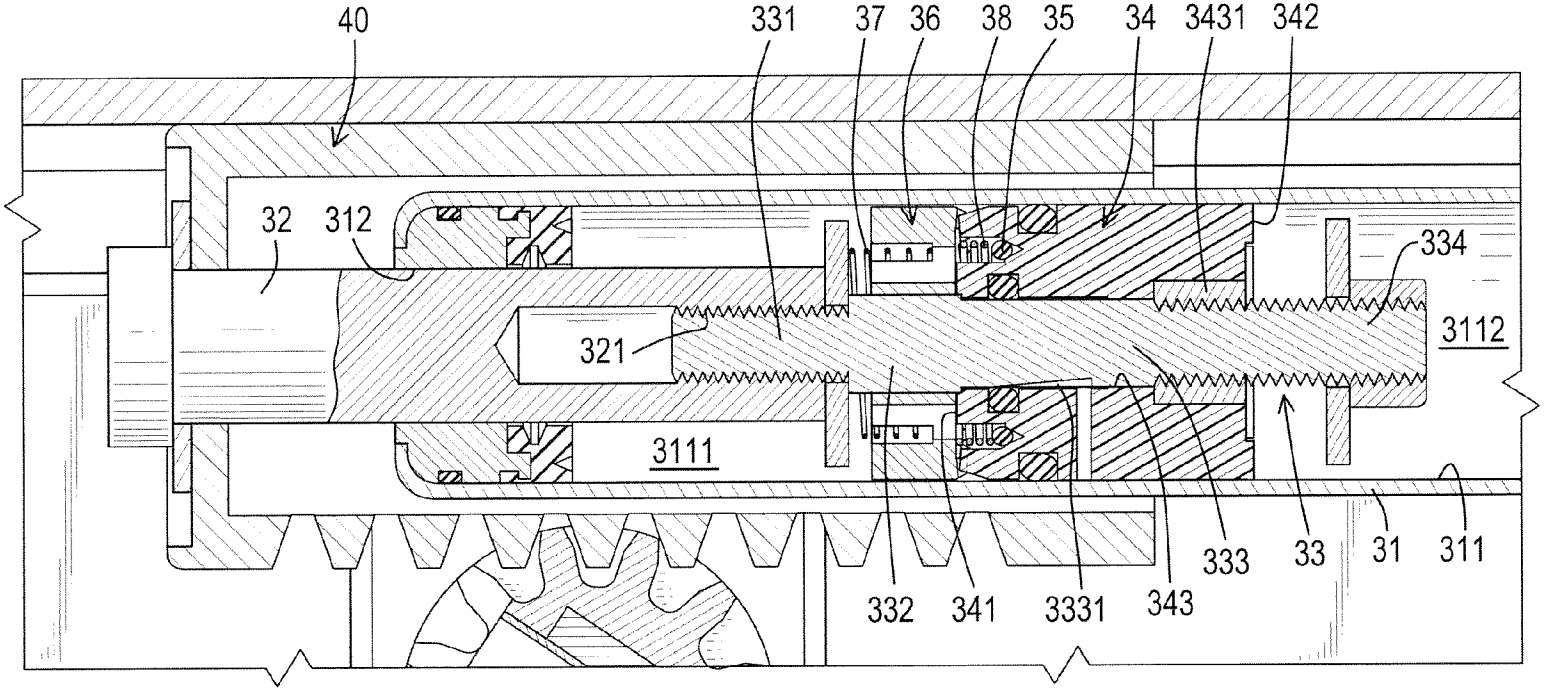
FIG. 4 is an enlarged cross-sectional top view of the door operator in FIG. 3.
Figure 5:
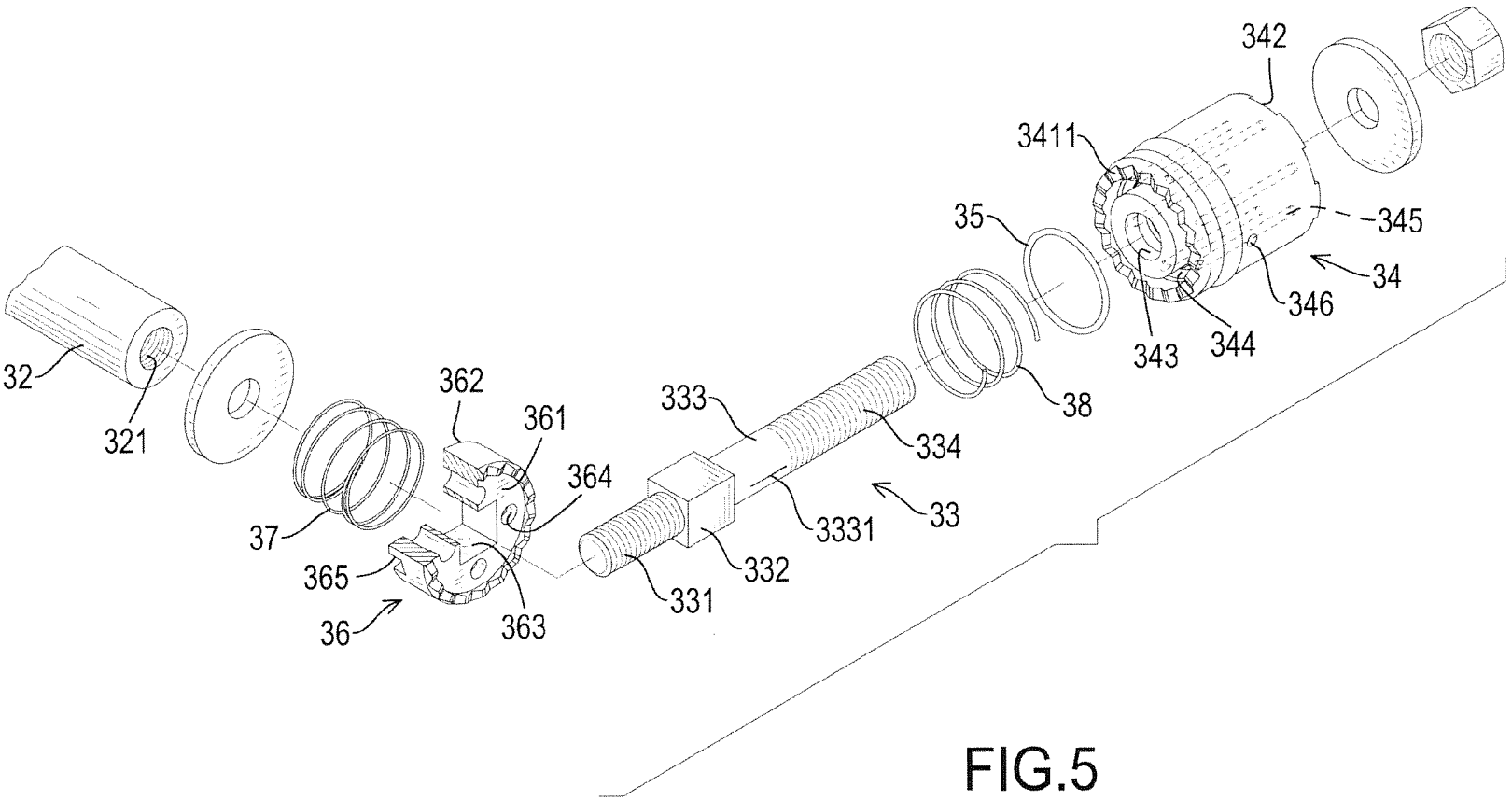
FIG. 5 is an exploded perspective view of a pneumatic apparatus of the door operator in FIG. 3.

With reference to FIGS. 3, 4 and 5, the pneumatic apparatus 30 is installed in the assembling space 110 and has a cylinder 31, a piston rod 32, an adjusting rod 33, a piston block 34, a sealing ring 35, a clutch ring 36, a first spring 37 and a second spring 38.

The cylinder 31 is circular in cross section and is mounted in the assembling space 110. The cylinder 31 has an axis, two ends, an inner space 311, an insertion hole 312, a screw hole 313 and an adjusting screw 314. The inner space 311 is formed inside the cylinder 31. The insertion hole 312 and the screw hole 313 are respectively formed at the two ends of the cylinder 31. The insertion hole 312 communicates with the inner space 311. The end of the cylinder 31 in which the screw hole 313 is formed is mounted on the housing 11. The adjusting screw 314 is adjustably screwed into the screw hole 313.

The piston rod 32 is moveably mounted in the insertion hole 312 of the cylinder 31. The piston rod 32 has two ends and a connecting hole 321. The connecting hole 321 is a threaded hole and is formed at one of the ends of the piston rod 32 that is inserted into the inner space 311 from the insertion hole 312.

The adjusting rod 33 is connected with the piston rod 32. The adjusting rod 33 sequentially includes a connecting portion 331, a fixing portion 332, a piston portion 333 and a protrusion 334. The connecting portion 331 is threaded and is screwed into the connecting hole 321. The fixing portion 332 is rectangular in cross section. A width of the fixing portion 332 is larger than a diameter of the connecting portion 331. The piston portion 333 is cylindrical and has an air-in slit 3331. The air-in slit 3331 is formed longitudinally in a periphery of the piston portion 333 and has a shallow end and a deep end. The air-in slit 3331 becomes gradually deep from the shallow end to the deep end. The distance from the deep end to the piston rod 32 is longer than the distance from the shallow end to the piston rod 32. A diameter of the piston portion 333 is smaller than the width of the fixing portion 332. The protrusion 334 is threaded.

The piston block 34 is cylindrical and is sleeved around the adjusting rod 33 and can be moved along the adjusting rod 33. The piston block 34 is accommodated in the inner space 311 of the cylinder 31 and divides the inner space 311 into a first chamber 3111 and a second chamber 3112. The first chamber 3111 is located adjacent to the insertion hole 312, and the second chamber 3112 is located away from the insertion hole 312 relative to the first chamber 3111. The piston block 34 has an axis, a first face 341, a second face 342, a fitting hole 343, an abutment recess 344, multiple air outlets 345 and an air inlet 346.

The first face 341 and the second face 342 are respectively defined at the two sides of the piston block 34. A waved face 3411 is formed on an outer edge of the first face 341. The fitting hole 343 is formed in a center of the first face 341 and the piston portion 333 is fitted into the fitting hole 343. A threaded face 3431 is formed inside the fitting hole 343 and adjacent to the second face 342. The protrusion 334 is correspondingly screwed with the threaded face 3431. The face 3431 may be integrated with the piston block 34 or may be formed on a nut that is mounted inside the fitting hole 343.

The abutment recess 344 is formed in the first face 341 around the fitting hole 343 and has a bottom. The air outlets 345 are formed through the bottom of the abutment recess 344, extend to the second face 342 and are arranged circularly. The air inlet 346 is formed through a periphery of the piston block 34 and corresponds in position to and communicates with the air-in slit 3331.

The sealing ring 35 is mounted in the abutment recess 344 and covers the air outlets 345.

The clutch ring 36 is sleeved around the fixing portion 332 and has an engagement face 361, an abutting face 362, a fixing hole 363, multiple air holes 364 and a spring recess 365. The engagement face 361 and the abutting face 362 are respectively at two sides of the clutch ring 36 and are opposite each other. An outer edge of the engagement face 361 is wave-shaped and is correspondingly engaged with the waved face 3411. The fixing hole 363 is rectangular, is formed through a center of the clutch ring 36, and the fixing portion 332 of the adjusting rod 33 is correspondingly fitted into the fixing hole 363. The air holes 364 are formed through the abutting face 362 and the engagement face 361 and are arranged around the fixing hole 363. The spring recess 365 is formed in the engagement face 361 and is disposed around the fixing hole 363.

The first spring 37 is mounted in the spring recess 365 and abuts between the clutch ring 36 and the piston rod 32.

The second spring 38 is mounted in the abutment recess 344 and abuts between the sealing ring 35 and the clutch ring 36.

Figure 6:
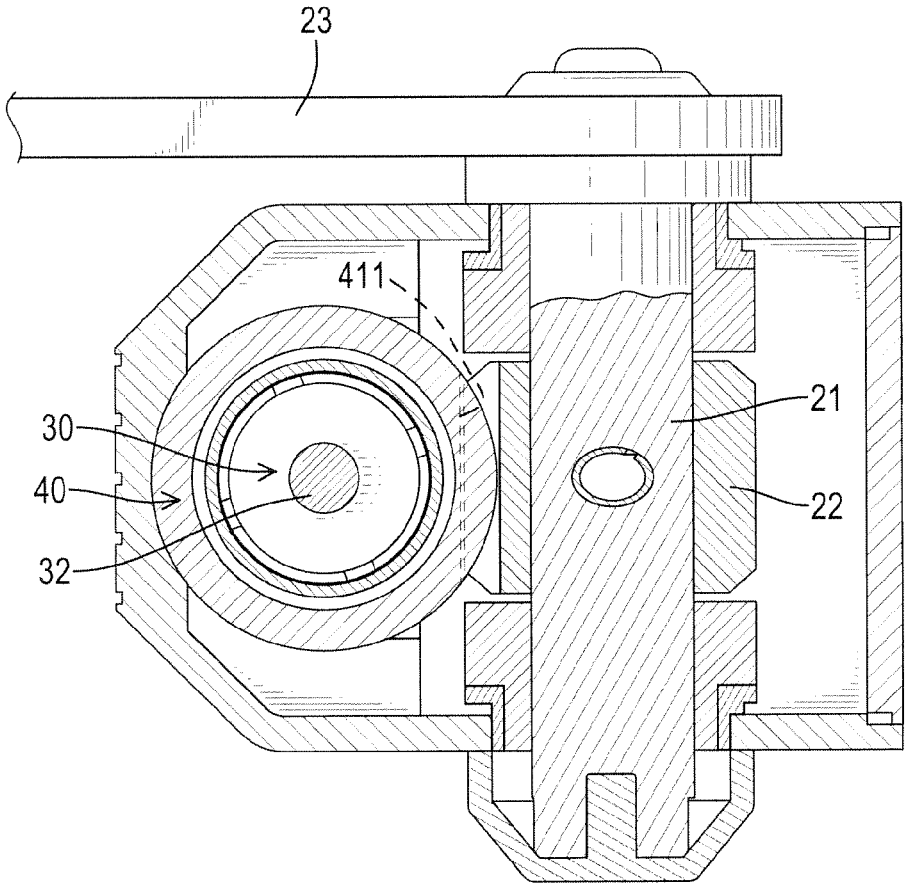
FIG. 6 is an enlarged side view in partial section of the door operator along line 6-6 in FIG. 1.

With reference to FIGS. 3 and 6, the moveable sleeve 40 is cylindrical, is movably mounted around the cylinder 31, is connected with the piston rod 32 and can be moved along the cylinder 31. A central axis of the moveable sleeve 40 is perpendicular to the rotation axis of the gear 22. The moveable sleeve 40 has a gear face 41. The gear face 41 is formed on an outer periphery of the moveable sleeve 40 and has multiple gear recesses 411. The gear recesses 411 are arranged longitudinally at intervals and are correspondingly engaged with the gear 22.

Figure 7:
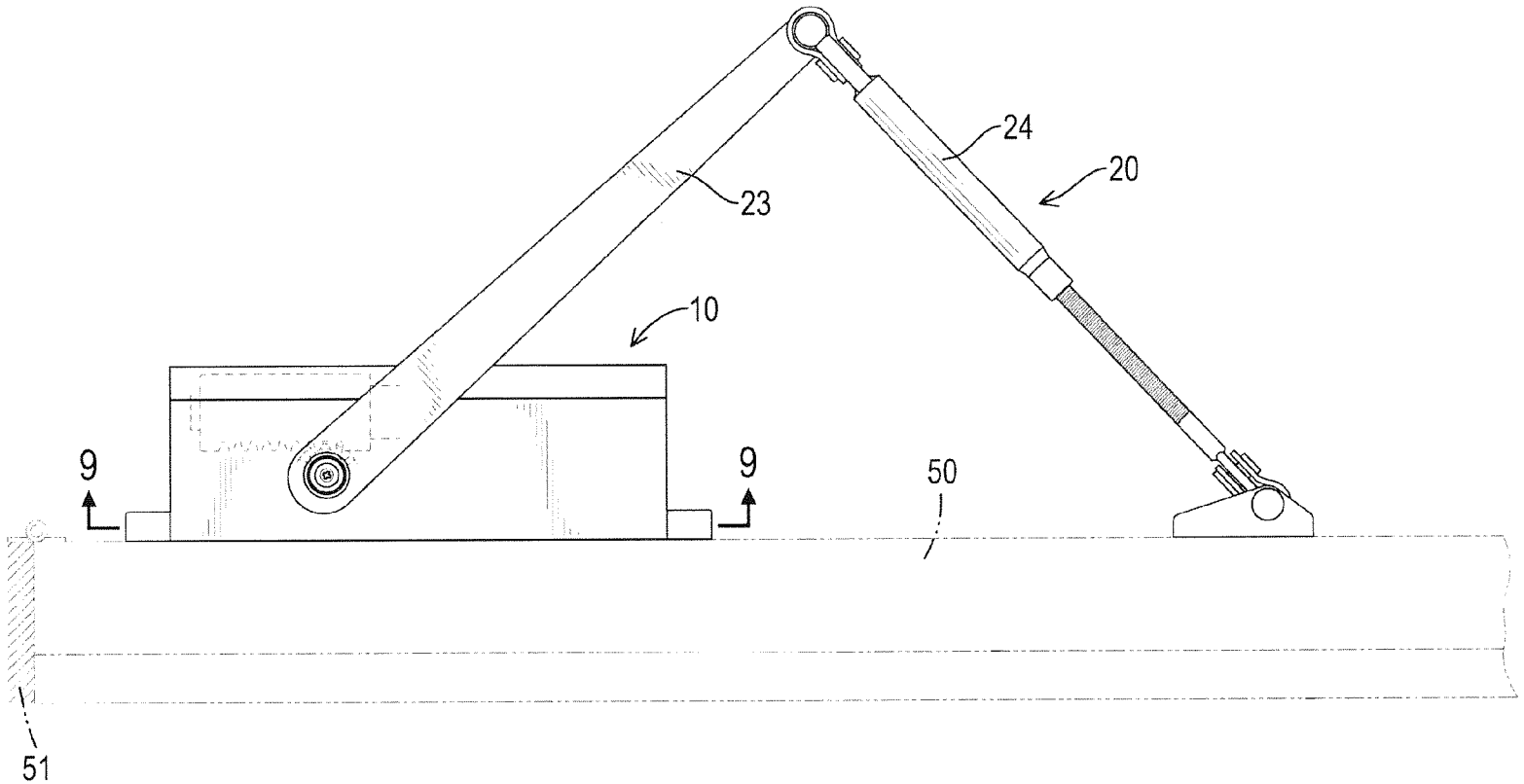
FIG. 7 is an operational top view of the door operator in FIG. 1 in a door closing status.
Figure 8:
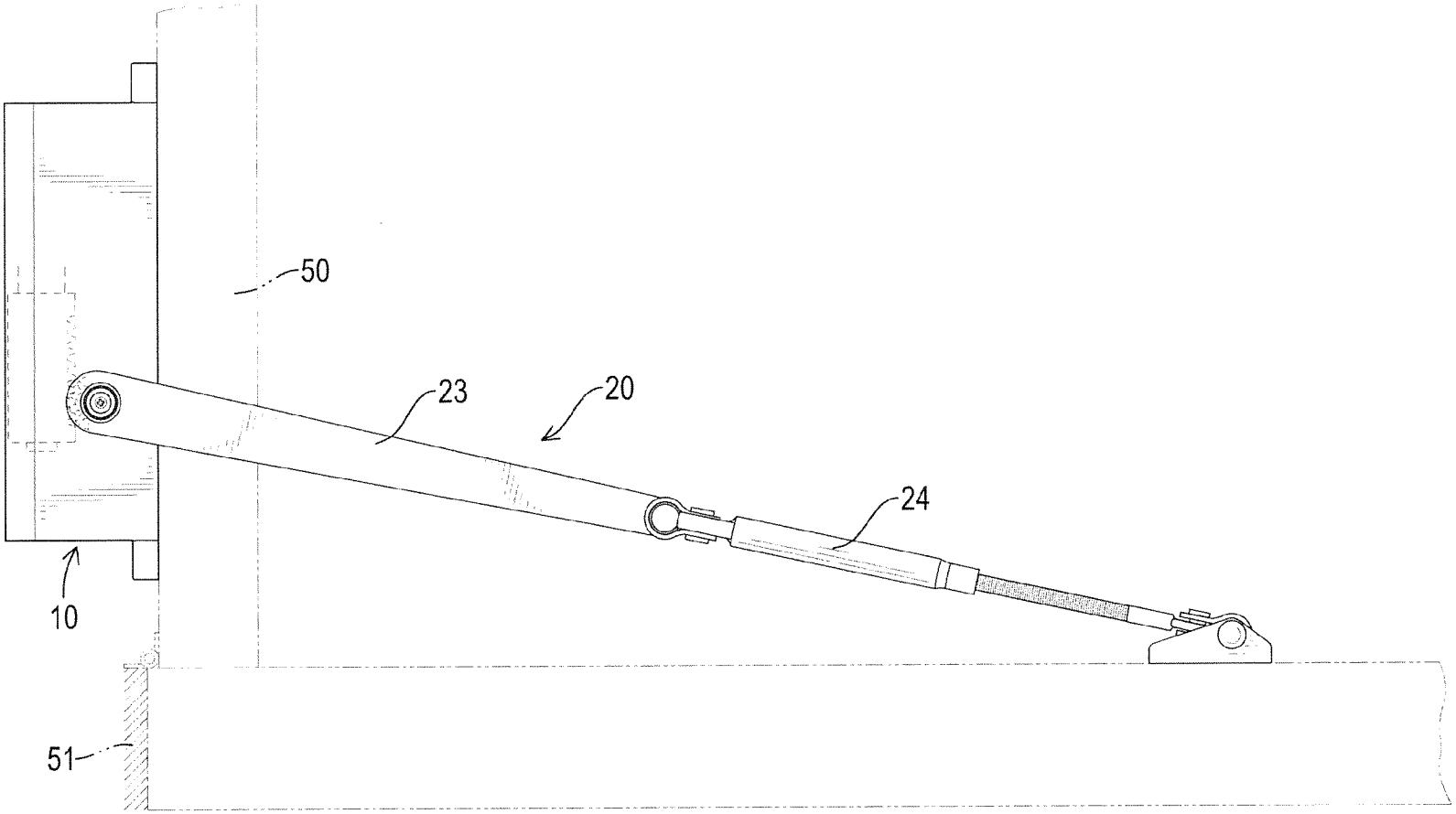
FIG. 8 is another operational top view of the door operator in FIG. 1 in a door opening status.

With reference to FIGS. 7 and 8, the installation box 10 and the operating mechanism 20 are respectively installed on a door 50 and a door frame 51. When the door 50 is opening or closing, the swing arm 23 and the rack 24 are swung toward or away from the door frame 51 and then the shaft 21 and the gear 22 are rotated counterclockwise or clockwise.

Figure 9:
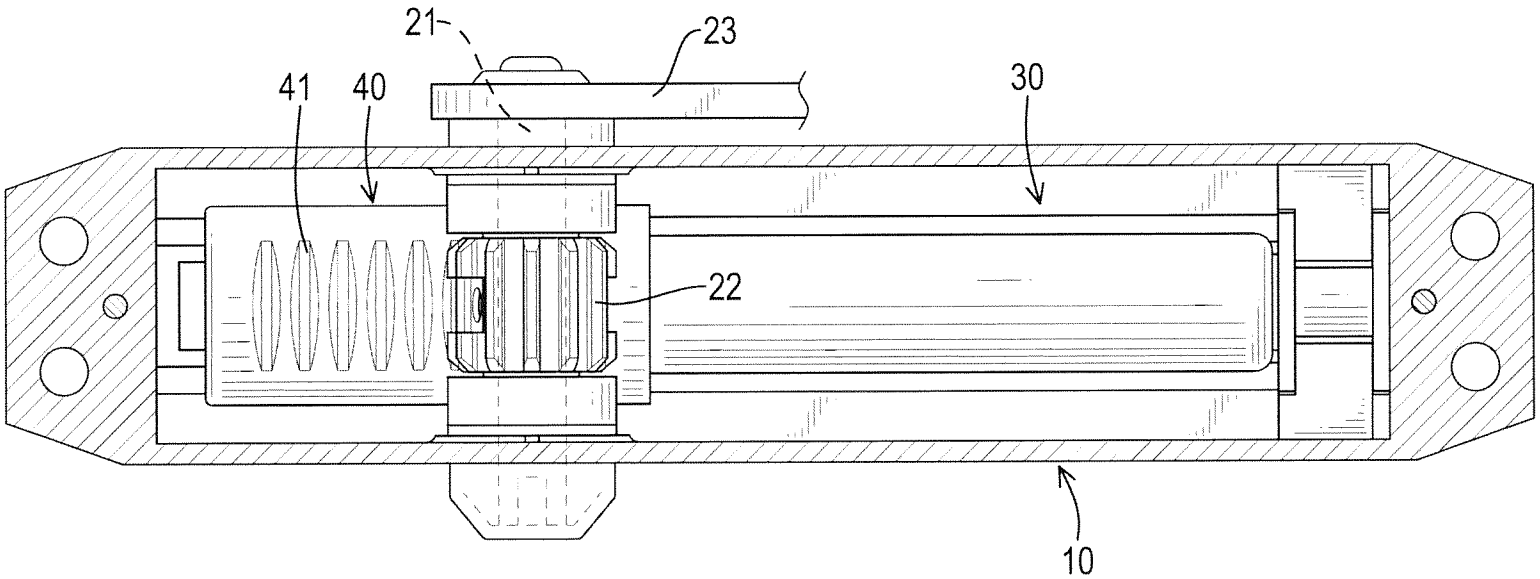
FIG. 9 is a side view in partial section of the door operator along line 9-9 in FIG. 7.
Figure 10:
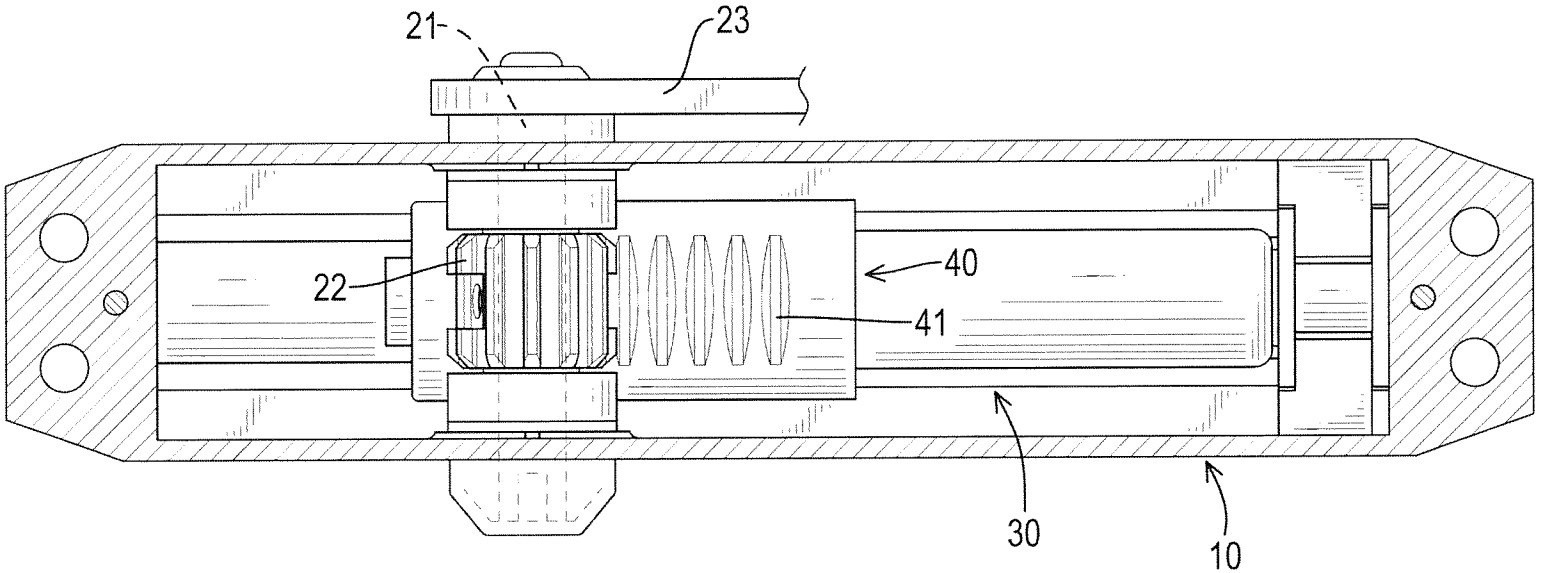
FIG. 10 is an operational side view in partial section of the door operator in FIG. 9.

With reference to FIGS. 9 and 10, the moveable sleeve 40 is driven by the rotation of the gear 22 and can move along the cylinder 31 and then pulls or pushes the piston rod 32 in the cylinder 31. In addition, the gear 22 and the moveable sleeve 40 are arranged perpendicular to each other, thus the horizontal length of the housing 11 and the volume of the installation box 10 are reduced such that the installation box has a simplistic appearance.

Figure 11:
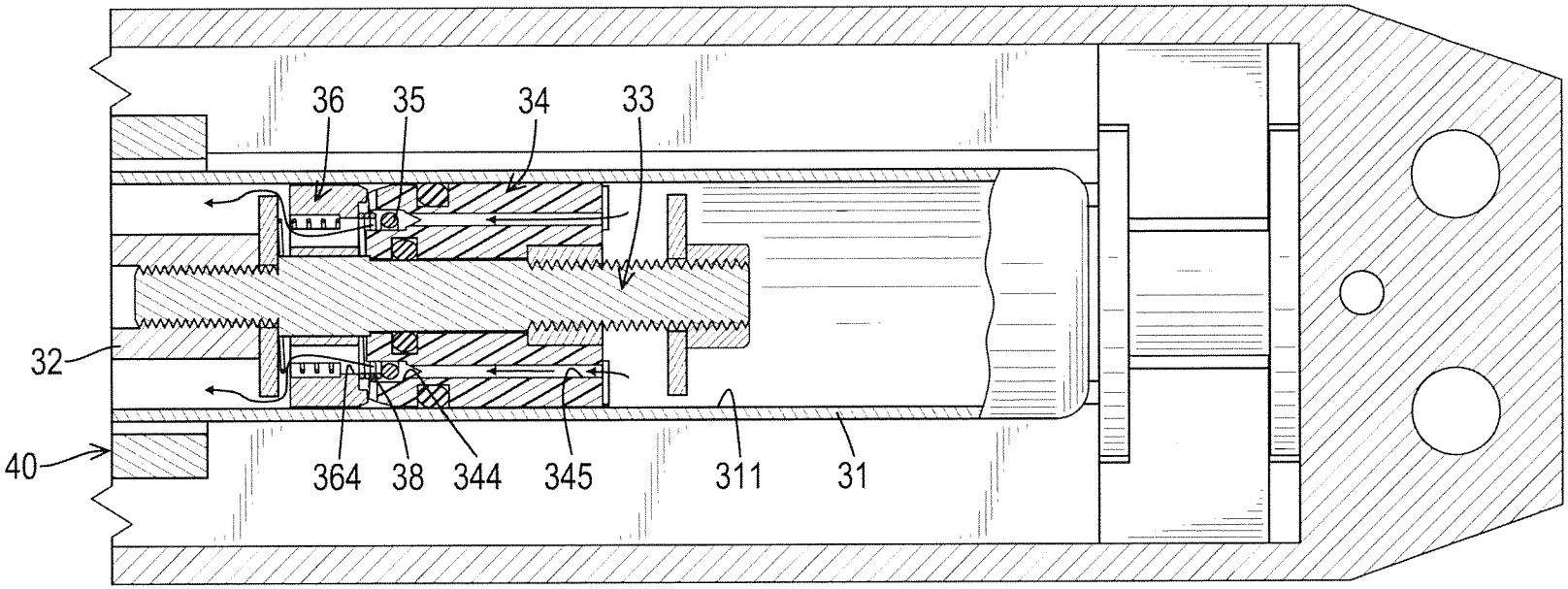
FIG. 11 is an operational side view in partial section of the pneumatic apparatus of the door operator in FIG. 9.

When the door 50 is opening, the position of the moveable sleeve 40 is changed as shown from FIG. 9 to FIG. 10. With reference to FIG. 11, the piston rod 32 is pulled into the cylinder 31, air in the second chamber 3112 of the cylinder 31 is compressed and flows from the second chamber 3112 to the first chamber 3111 via the air outlets 345. The sealing ring 35 is pushed away from the abutment recess 344 by the air and then the second spring 38 is compressed so that the air can easily and quickly go out from the air holes 364 or a gap between the clutch ring 36 and the cylinder 31.

After the piston rod 32 is stopped pulling, the second spring 38 pushes the sealing ring 35 to cover the air outlets 345 for keeping the air staying behind the piston block 34.

Figure 12:
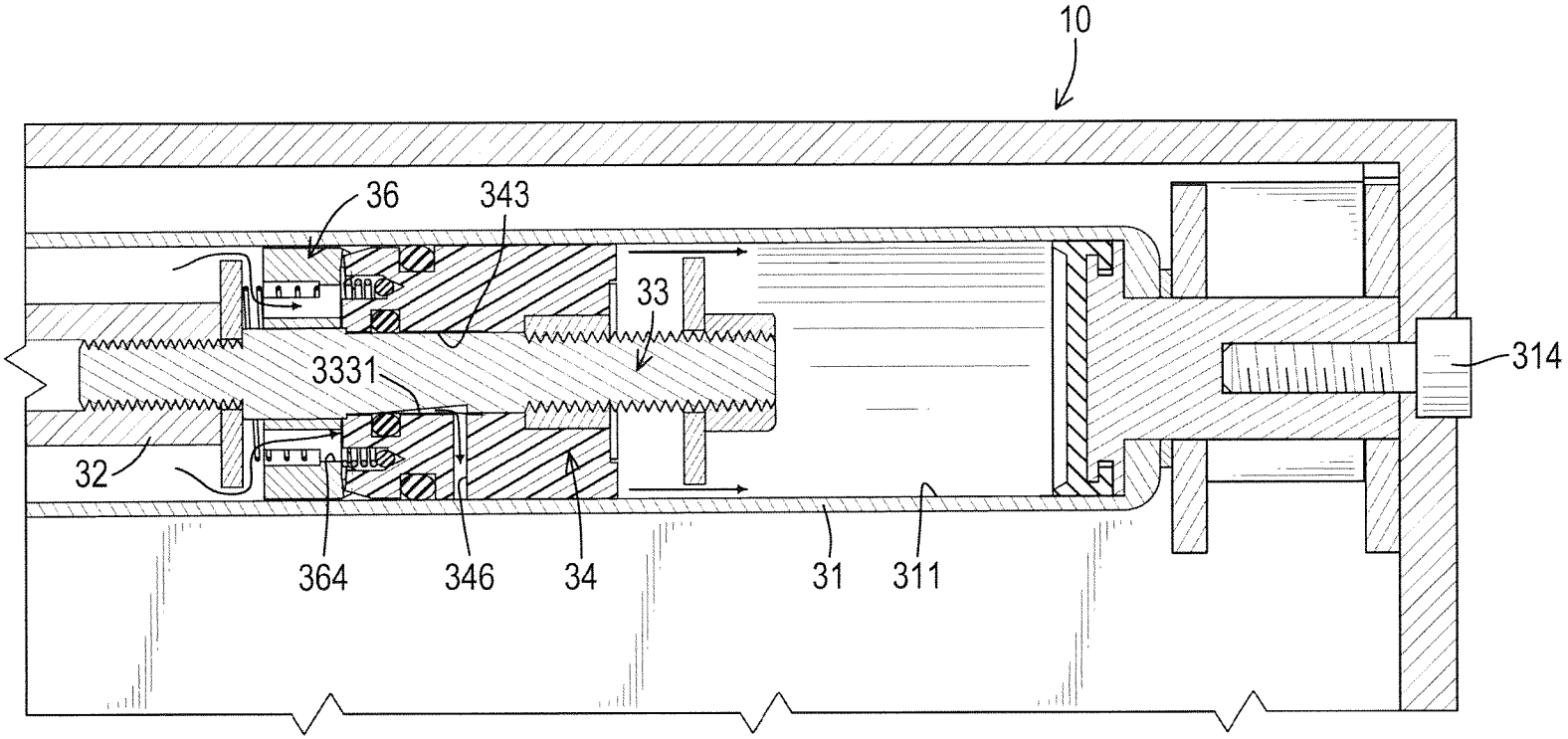
FIG. 12 is another operational side view in partial section of the pneumatic apparatus of the door operator in FIG. 10.

When the door 50 is closing, the position of the moveable sleeve 40 is changed as shown from FIG. 10 to FIG. 9. With reference to FIG. 12, the piston rod 32 is pulled from the cylinder 31 and then the air flows into the inner space 311 behind the piston block 34 via the air holes 364, the fitting hole 343, the air-in slit 3331 and air inlet 346. The speed of the air flow is slow because the air can only enter the first chamber 3111 from the second chamber 3112 via the air-in slit 3331 and the air inlet 346. Therefore, the closing speed of the door 50 is slower than the opening speed.

When the adjusting screw 314 is rotated, the cylinder 31 and the piston block 34 can be moved along the adjusting rod 33. The air inlet 346 is moved to selectively align with the air-in slit 3331 at various positions with different depths for changing flow rates of air and the speed of the door closing.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A door operator comprising:

an installation box having:

a housing having a top, a bottom, an assembling space and an opening communicating with the assembling space; and a lid mounted in the opening and covering the assembling space;

an operating mechanism rotatably connected with the installation box and having a shaft rotatably mounted on the top of the housing through the bottom of the housing;

a gear mounted on the shaft, driven by the shaft and having a rotation axis;

a swing arm having two ends, one of the two ends of the swing arm pivotally mounted on a top end of the shaft and outside the housing;

a rack connected to the other end of the swing arm;

a pneumatic apparatus installed in the assembling space and having a cylinder having an inner space and an insertion hole communicating with the inner space;

a piston rod being moveable and mounted in the insertion hole of the cylinder;

an adjusting rod connected with the piston rod and having an air-in slit longitudinally formed in a periphery of the adjusting rod;

a piston block mounted around the adjusting rod and having a first face, a fitting hole, an abutment recess, multiple air outlets and an air inlet; the first face defined at one side of the piston block, the fitting hole formed in a center of the first face and the adjusting rod fitted into the fitting hole, the abutment recess formed in the first face of the piston block and has a bottom, the air outlets formed through the bottom of the abutment recess and arranged circularly, the air inlet mounted through a periphery of the piston block and corresponding in position to and communicating with the air-in slit;

a sealing ring mounted in the abutment recess and covering the air outlets;

a clutch ring mounted around the adjusting rod and engaged with the piston block;

a first spring abutting between the clutch ring and the piston rod;

a second spring mounted in the abutment recess and abutting between the sealing ring and the clutch ring; and a moveable sleeve movably mounted around the cylinder and connected with the piston rod, the moveable sleeve having a gear face and a central axis, the central axis of the moveable sleeve being perpendicular to the rotation axis of the gear, and the gear face correspondingly engaged with the gear.

2. The door operator as claimed in claim 1, wherein the gear face of the moveable sleeve has multiple gear recesses, and the gear recesses are arranged longitudinally at intervals and correspondingly engaged with the gear.

3. The door operator as claimed in claim 2, wherein the adjusting rod sequentially includes a connecting portion, a fixing portion, a piston portion and a protrusion;

the connecting portion is threaded and connected with the piston rod; and the fixing portion is rectangular in cross section, a width of the fixing portion is larger than a diameter of the connecting portion, the air-in slit is formed in a periphery of the piston portion; and the protrusion is threaded.

4. The door operator as claimed in claim 3, wherein the clutch ring has an engagement face, an abutting face and multiple air holes; the engagement face and the abutting face are respectively positioned at two sides of the clutch ring and are opposite each other; the air holes are formed through the abutting face and the engagement face and are arranged circularly.

5. The door operator as claimed in claim 4, wherein a waved face is formed on an outer edge of the first face; an outer edge of the engagement face is wave-shaped and is correspondingly engaged with the waved face.

6. The door operator as claimed in claim 5, wherein a threaded face is formed inside the fitting hole; the protrusion is correspondingly screwed with the threaded face.

7. The door operator as claimed in claim 2, wherein the air-in slit has a shallow end and a deep end, the air-in slit becomes gradually deeper from the shallow end to the deep end, and a distance from the deep end to the piston rod is longer than a distance from the shallow end to the piston rod.

8. The door operator as claimed in claim 3, wherein the air-in slit has a shallow end and a deep end, the air-in slit becomes gradually deeper from the shallow end to the deep end, and a distance from the deep end to the piston rod is longer than a distance from the shallow end to the piston rod.

9. The door operator as claimed in claim 4, wherein the air-in slit has a shallow end and a deep end, the air-in slit becomes gradually deeper from the shallow end to the deep end, and a distance from the deep end to the piston rod is longer than a distance from the shallow end to the piston rod.

10. The door operator as claimed in claim 5, wherein the air-in slit has a shallow end and a deep end, the air-in slit becomes gradually deeper from the shallow end to the deep end, and a distance from the deep end to the piston rod is longer than a distance from the shallow end to the piston rod.

11. The door operator as claimed in claim 6, wherein the air-in slit has a shallow end and a deep end, the air-in slit becomes gradually deeper from the shallow end to the deep end, and a distance from the deep end to the piston rod is longer than a distance from the shallow end to the piston rod.

* * * * *